US009422776B2

(12) United States Patent
Wagoner et al.

(10) Patent No.: US 9,422,776 B2
(45) Date of Patent: Aug. 23, 2016

(54) ROTATING CONTROL DEVICE HAVING JUMPER FOR RISER AUXILIARY LINE

(71) Applicant: Weatherford Technology Holdings, LLC, Houston, TX (US)

(72) Inventors: Danny W. Wagoner, Waller, TX (US); Gordon Thomson, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 14/593,329

(22) Filed: Jan. 9, 2015

(65) Prior Publication Data

US 2015/0204146 A1 Jul. 23, 2015

Related U.S. Application Data

(60) Provisional application No. 61/929,342, filed on Jan. 20, 2014.

(51) Int. Cl.

| | |
|---|---|
| ***E21B 17/01*** | (2006.01) |
| ***E21B 19/00*** | (2006.01) |
| ***E21B 17/04*** | (2006.01) |
| ***E21B 33/035*** | (2006.01) |
| ***E21B 33/02*** | (2006.01) |
| ***E21B 33/08*** | (2006.01) |
| ***E21B 7/12*** | (2006.01) |

(52) U.S. Cl.

CPC ..... *E21B 19/004* (2013.01); *E21B 7/12* (2013.01); *E21B 17/01* (2013.01); *E21B 17/04* (2013.01); *E21B 33/085* (2013.01)

(58) Field of Classification Search

None

See application file for complete search history.

(56) References Cited

U.S. PATENT DOCUMENTS

| | | | | |
|---|---|---|---|---|
| 4,192,380 | A | 3/1980 | Smith | |
| 4,496,173 | A | 1/1985 | Roche et al. | |
| 4,550,936 | A | 11/1985 | Haeber et al. | |
| 7,337,854 | B2 | 3/2008 | Horn et al. | |
| 9,074,425 | B2 * | 7/2015 | Feasey | E21B 21/08 |
| 9,222,315 | B2 * | 12/2015 | Chen | E21B 17/085 |
| 2010/0319925 | A1 | 12/2010 | Papon et al. | |
| 2014/0178155 | A1 | 6/2014 | Feasey | |
| 2016/0076312 | A1 * | 3/2016 | Fraczek | E21B 19/002 166/367 |

FOREIGN PATENT DOCUMENTS

| | | | |
|---|---|---|---|
| GB | 2138908 | A | 10/1984 |
| WO | 2013/006963 | A1 | 1/2013 |
| WO | 2014/099965 | A2 | 6/2014 |
| WO | 2014/179538 | A1 | 11/2014 |

OTHER PUBLICATIONS

EPO Extended European Search Report dated Jun. 10, 2015, for EPO Applicaiton No. 15151610.1.

Canadian Office Action dated Feb. 2, 2016, for Canadian Patent Application No. 2,878,557.

Australian Examination Report dated Oct. 13, 2015 for Application No. 2015200185.

* cited by examiner

*Primary Examiner* — Matthew R Buck
*Assistant Examiner* — Douglas S Wood
(74) *Attorney, Agent, or Firm* — Patterson & Sheridan, LLP

(57) ABSTRACT

A rotating control device housing includes an upper riser flange; a lower riser flange; a latch section for receiving a bearing assembly and connected to the upper riser flange; a port section connected to the latch section by a flanged connection, having an outlet for discharging fluid flow diverted by the bearing assembly, and connected to the lower riser flange; and a jumper connected to the upper and lower riser flanges.

14 Claims, 12 Drawing Sheets

ROTATING CONTROL DEVICE HAVING JUMPER FOR RISER AUXILIARY LINE

CROSS-REFERENCE TO RELATED APPLICATIONS

This application claims benefit of U.S. Provisional Patent Application Ser. No. 61/929,342, filed Jan. 20, 2014, which is herein incorporated by reference.

BACKGROUND OF THE INVENTION

1. Field of the Invention

The present invention generally relates to a rotating control device having a jumper for a riser auxiliary line.

2. Description of the Related Art

In wellbore construction and completion operations, a wellbore is formed to access hydrocarbon-bearing formations (e.g., crude oil and/or natural gas) by the use of drilling. Drilling is accomplished by utilizing a drill bit that is mounted on the end of a drill string. To drill within the wellbore to a predetermined depth, the drill string is often rotated by a top drive or rotary table on a surface platform or rig, and/or by a downhole motor mounted towards the lower end of the drill string. After drilling to a predetermined depth, the drill string and drill bit are removed and a section of casing is lowered into the wellbore. An annulus is thus formed between the string of casing and the formation. The casing string is temporarily hung from the surface of the well. A cementing operation is then conducted in order to fill the annulus with cement. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

Deep water offshore drilling operations are typically carried out by a mobile offshore drilling unit (MODU), such as a drill ship or a semi-submersible, having the drilling rig aboard and often make use of a marine riser extending between the wellhead of the well that is being drilled in a subsea formation and the MODU. The marine riser is a tubular string made up of a plurality of tubular sections that are connected in end-to-end relationship. The riser allows return of the drilling mud with drill cuttings from the hole that is being drilled. Also, the marine riser is adapted for being used as a guide means for lowering equipment (such as a drill string carrying a drill bit) into the hole.

SUMMARY OF THE INVENTION

The present invention generally relates to a rotating control device having a jumper for a riser auxiliary line. In one embodiment, a rotating control device housing includes an upper riser flange; a lower riser flange; a latch section for receiving a bearing assembly and connected to the upper riser flange; a port section connected to the latch section by a flanged connection, having an outlet for discharging fluid flow diverted by the bearing assembly, and connected to the lower riser flange; and a jumper connected to the upper and lower riser flanges.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

Figure 1A:
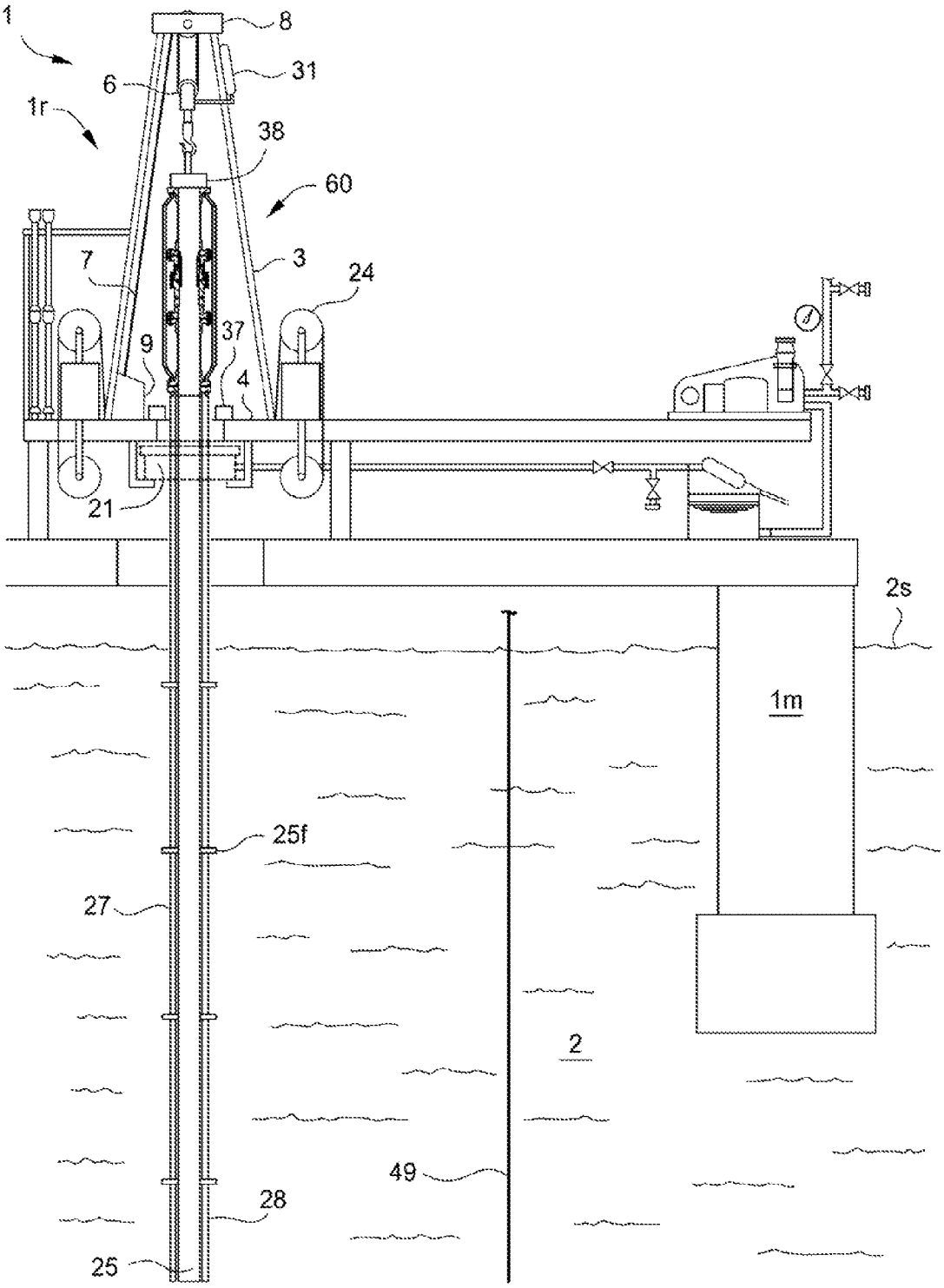
FIGS. 1A-1D illustrate an offshore drilling system in a riser deployment mode, according to one embodiment of the present invention.
Figure 1B:
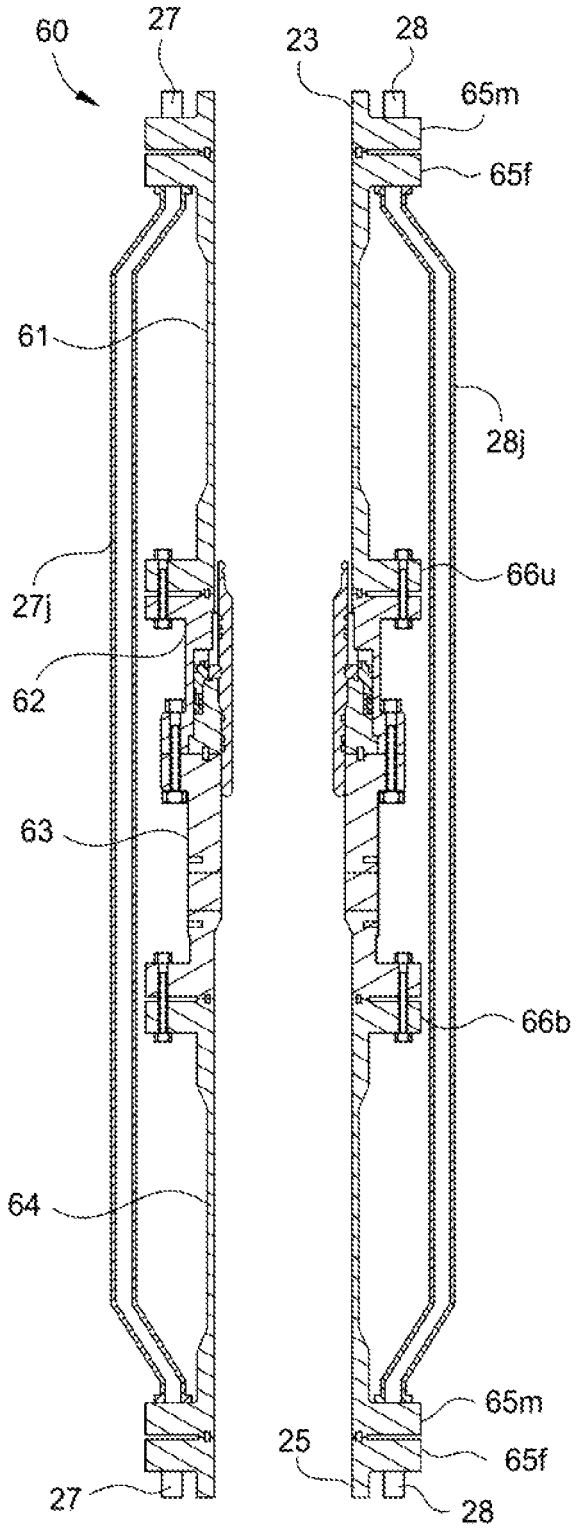
Figure 1C:
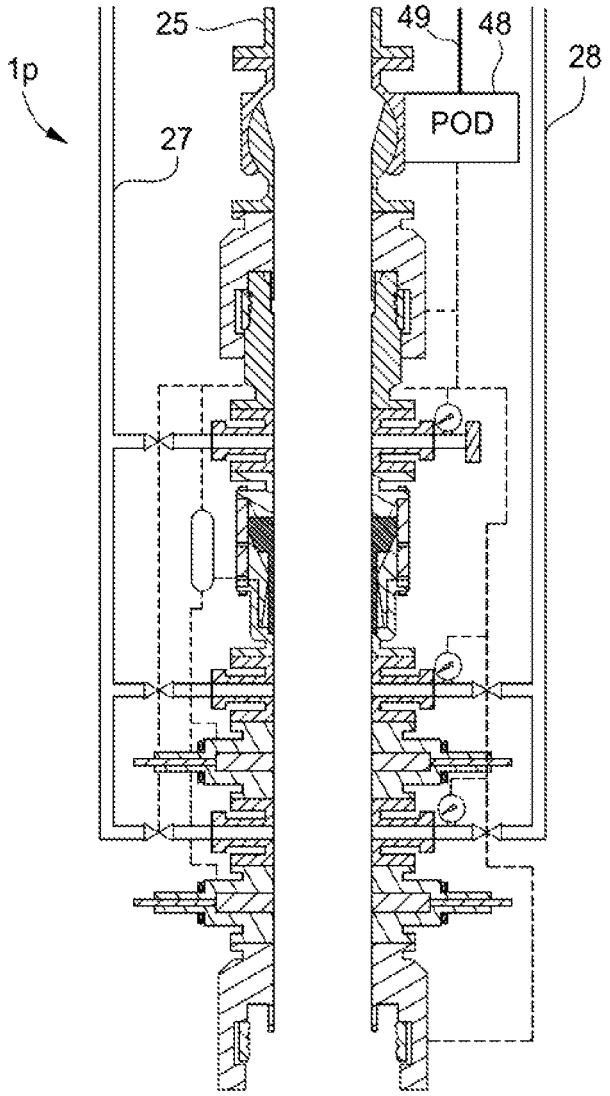
Figure 1D:
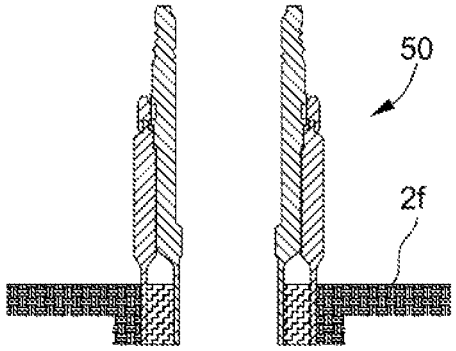

FIGS. 1A-1D illustrate an offshore drilling system 1 in a riser deployment mode, according to one embodiment of the present invention. The drilling system 1 may include a mobile offshore drilling unit (MODU) 1*m*, such as a semi-submersible, a drilling rig 1*r*, a fluid handling system 1*h* (only partially shown, see FIG. 3A), a fluid transport system 1*t* (only partially shown, see FIGS. 3A-3C), and a pressure control assembly (PCA) 1*p* (see FIG. 1B). The MODU 1*m* may carry the drilling rig 1*r* and the fluid handling system 1*h* aboard and may include a moon pool, through which operations are conducted. The semi-submersible MODU 1*m* may include a lower barge hull which floats below a surface (aka waterline) 2*s* of sea 2 and is, therefore, less subject to surface wave action. Stability columns (only one shown) may be mounted on the lower barge hull for supporting an upper hull above the waterline. The upper hull may have one or more decks for carrying the drilling rig 1*r* and fluid handling system 1*h*. The MODU 1*m* may further have a dynamic positioning system (DPS) (not shown) or be moored for maintaining the moon pool in position over a subsea wellhead 50.

Alternatively, the MODU 1*m* may be a drill ship. Alternatively, a fixed offshore drilling unit or a non-mobile floating offshore drilling unit may be used instead of the MODU 1*m*.

The drilling rig 1*r* may include a derrick 3 having a rig floor 4 at its lower end having an opening corresponding to the moonpool. The rig 1*r* may further include a traveling block 6 be supported by wire rope 7. An upper end of the wire ripe 7 may be coupled to a crown block 8. The wire rope 7 may be woven through sheaves of the blocks 6, 8 and extend to drawworks 9 for reeling thereof, thereby raising or lowering the traveling block 6 relative to the derrick 3. A running tool 38 may be connected to the traveling block 6, such as by a rig compensator 36. Alternatively, the rig compensator may be disposed between the crown block 8 and the derrick 3.

Figure 3A:
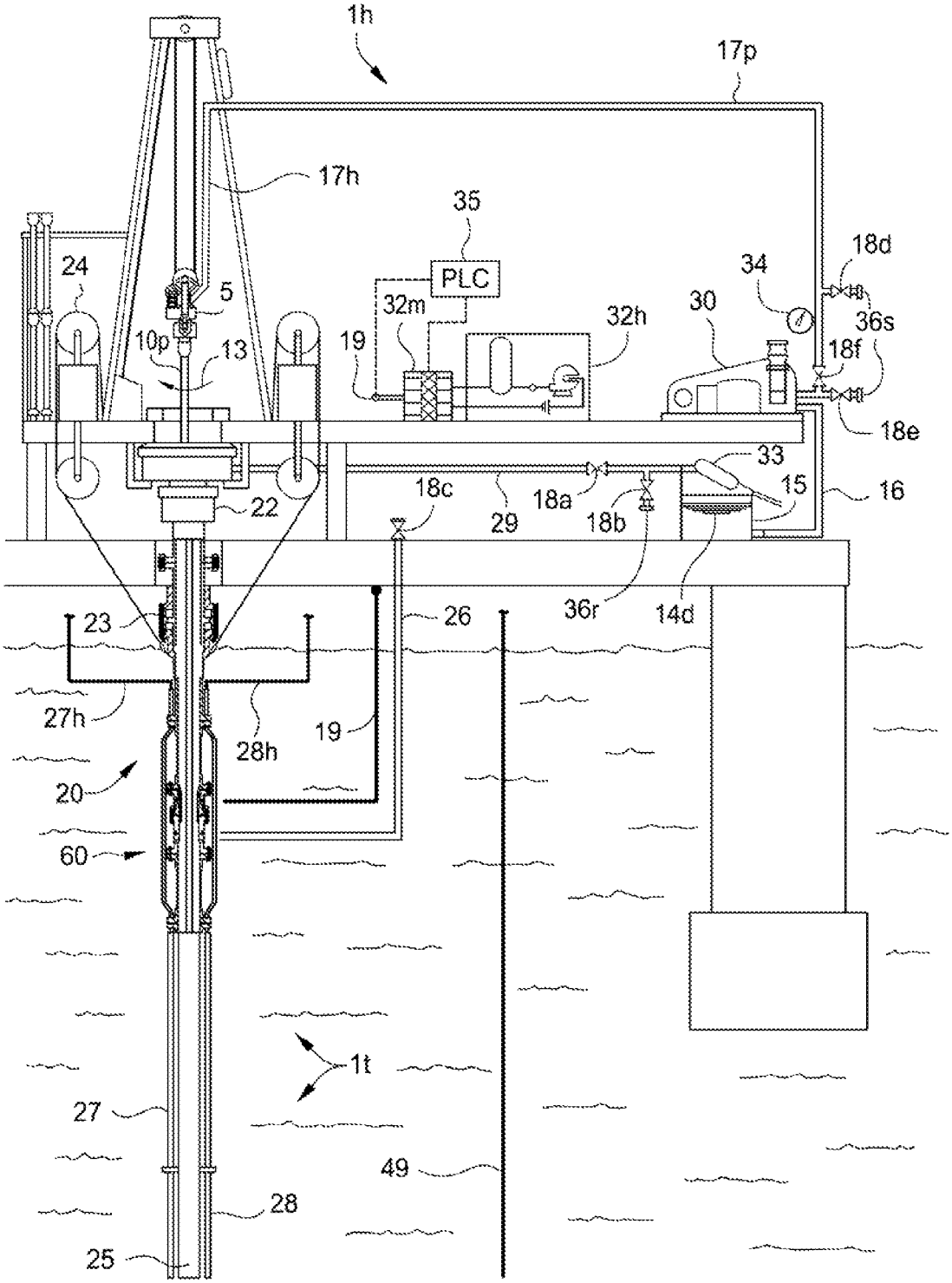
FIGS. 3A-3C illustrate the offshore drilling system in an overbalanced drilling mode.
Figure 3B:
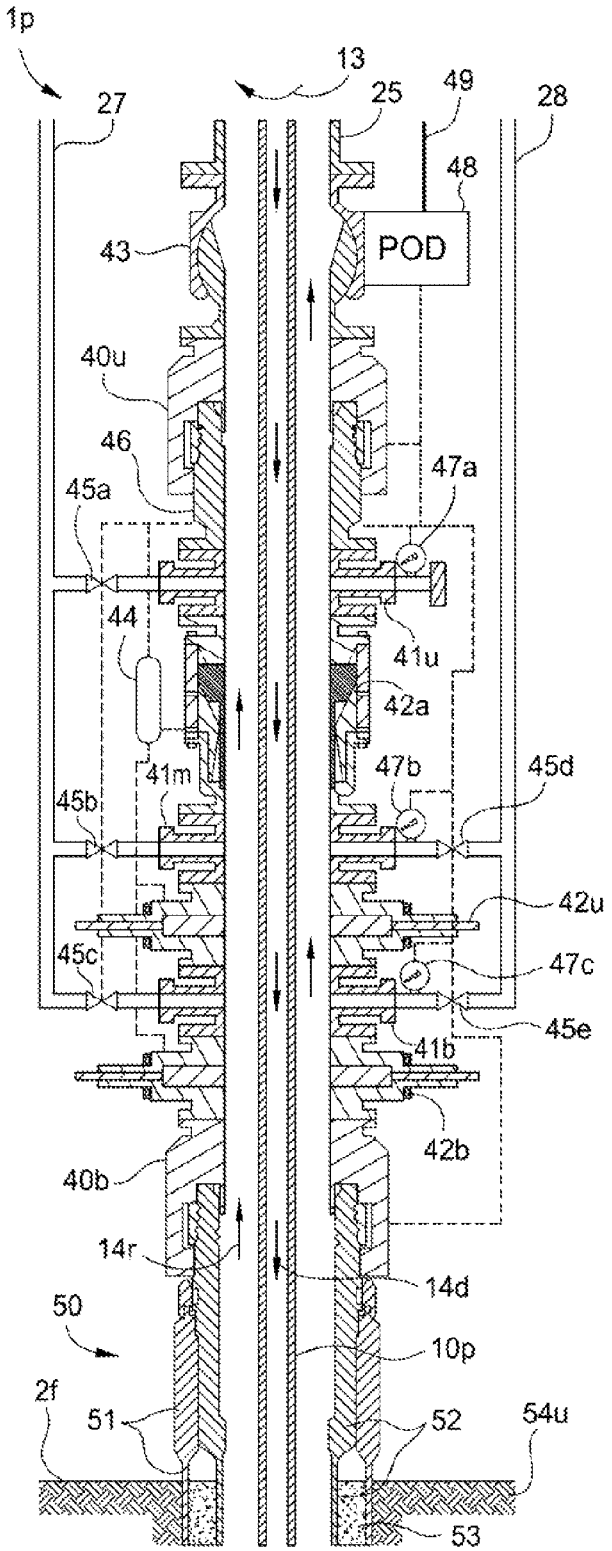
Figure 3C:
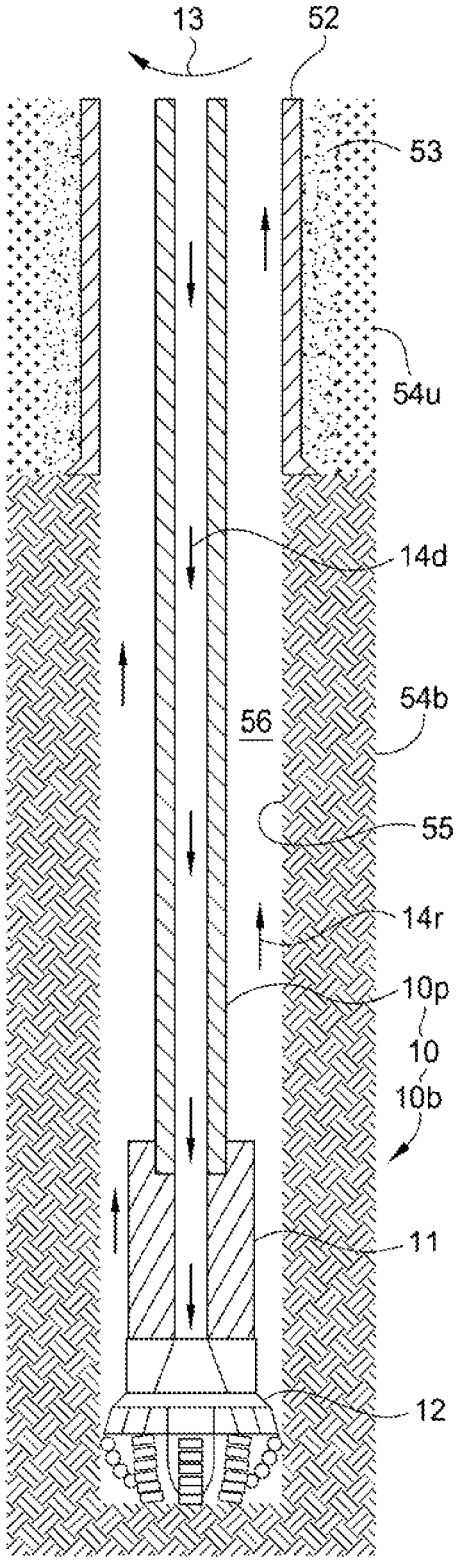

A fluid transport system it (shown in FIG. 3A) may include an upper marine riser package (UMRP) 20 (only partially shown, see FIG. 3A), a marine riser 25, one or more auxiliary lines 27, 28, such as a booster line 27 and a choke line 28, and a drill string 10 (in drilling mode, see FIGS. 3A-3C). Additionally, the auxiliary lines 27, 28 may further include a kill line (not shown) and/or one or more hydraulic lines for charging the accumulators 44. During deployment, the PCA 1*p* may be connected to a wellhead 50 located adjacent to a floor 2*f* of the sea 2.

A conductor string 51 may be driven into the seafloor 2*f*. The conductor string 51 may include a housing and joints of conductor pipe connected together, such as by threaded connections. Once the conductor string 51 has been set, a subsea wellbore 55 (shown in FIG. 3C) may be drilled into the seafloor 2*f* and a casing string 52 (shown in FIG. 3C) may be deployed into the wellbore. The casing string 52 may include a wellhead housing and joints of casing connected together, such as by threaded connections. The wellhead housing may land in the conductor housing during deployment of the casing string 52. The casing string 52 may be cemented 53 into the wellbore 55 (shown in FIG. 3C). The casing string 52 may extend to a depth adjacent a bottom of an upper formation 54*u* (shown in FIG. 3C). The upper formation 54*u* may be non-productive and a lower formation 54*b* may be a hydrocarbon-bearing reservoir (shown in FIG. 3C). Alternatively, the lower formation 54*b* may be environmentally sensitive, such as an aquifer, or unstable. Although shown as vertical, the wellbore 55 may include a vertical portion and a deviated, such as horizontal, portion.

The PCA 1*p* may include a wellhead adapter 40*b*, one or more flow crosses 41*u,m,b*, one or more blow out preventers (BOPs) 42*a,u,b*, a lower marine riser package (LMRP), one or more accumulators 44, and a receiver 46. The LMRP may include a control pod 48, a flex joint 43, and a connector 40*u*. The wellhead adapter 40*b*, flow crosses 41*u,m,b*, BOPs 42*a,u,b*, receiver 46, connector 40*u*, and flex joint 43, may each include a housing having a longitudinal bore therethrough and may each be connected, such as by flanges, such that a continuous bore is maintained therethrough. The bore may have drift diameter, corresponding to a drift diameter of the wellhead 50.

Each of the connector 40*u* and wellhead adapter 40*b* may include one or more fasteners, such as dogs, for fastening the LMRP to the BOPs 42*a,u,b* and the PCA 1*p* to an external profile of the wellhead housing, respectively. Each of the connector 40*u* and wellhead adapter 40*b* may further include a seal sleeve for engaging an internal profile of the respective receiver 46 and wellhead housing. Each of the connector 40*u* and wellhead adapter 40*b* may be in electric or hydraulic communication with the control pod 48 and/or further include an electric or hydraulic actuator and an interface, such as a hot stab, so that a remotely operated subsea vehicle (ROV) (not shown) may operate the actuator for engaging the dogs with the external profile.

The LMRP may receive a lower end of the riser 25 and connect the riser to the PCA 1*p*. The control pod 48 may be in electric, hydraulic, and/or optical communication with a rig controller (not shown) onboard the MODU 1*m* via an umbilical 49. The control pod 48 may include one or more control valves (not shown) in communication with the BOPs 42*a,u,b* for operation thereof. Each control valve may include an electric or hydraulic actuator in communication with the umbilical 49. The umbilical 49 may include one or more hydraulic or electric control conduit/cables for the actuators. The accumulators 44 may store pressurized hydraulic fluid for operating the BOPs 42*a,u,b*. Additionally, the accumulators 44 may be used for operating one or more of the other components of the PCA 1*p*. The umbilical 49 may further include hydraulic, electric, and/or optic control conduit/cables for operating various functions of the PCA 1*p*. The rig controller may operate the PCA 1*p* via the umbilical 49 and the control pod 48.

A lower end of the booster line 27 may be connected to a branch of the flow cross 41*u* by a shutoff valve 45*a*. A booster manifold may also connect to the booster line lower end and have a prong connected to a respective branch of each flow cross 41*m,b*. Shutoff valves 45*b,c* may be disposed in respective prongs of the booster manifold. Alternatively, the kill line may be connected to the branches of the flow crosses 41*m,b* instead of the booster manifold. An upper end of the booster line 27 may be connected to an outlet of a booster pump (not shown) and an upper end of the choke line may be connected to a rig choke (not shown). A lower end of the choke line 28 may have prongs connected to respective second branches of the flow crosses 41*m,b*. Shutoff valves 45*d,e* may be disposed in respective prongs of the choke line lower end.

A pressure sensor 47*a* may be connected to a second branch of the upper flow cross 41*u*. Pressure sensors 47*b,c* may be connected to the choke line prongs between respective shutoff valves 45*d,e* and respective flow cross second branches. Each pressure sensor 47*a-c* may be in data communication with the control pod 48. The lines 27, 28 and may extend between the MODU 1*m* and the PCA 1*p* by being fastened to flanged connections 25*f* between joints of the riser 25. The umbilical 49 may also extend between the MODU 1*m* and the PCA 1*p*. Each shutoff valve 45*a-e* may be automated and have a hydraulic actuator (not shown) operable by the control pod 48 via fluid communication with a respective umbilical conduit or the LMRP accumulators 44. Alternatively, the valve actuators may be electrical or pneumatic.

Once deployed, the riser 25 may extend from the PCA 1*p* to the MODU 1*m* and may connect to the MODU via the UMRP 20 (see FIG. 3A). The UMRP 20 may include a diverter 21 (only housing shown), a flex joint 22 (see FIG. 3A), a slip (aka telescopic) joint 23 upon deployment (see FIG. 3A), a tensioner 24, and a rotating control device (RCD) housing 60. A lower end of the RCD housing 60 may be connected to an upper end of the riser 25, such as by a flanged connection. The slip joint 23 may include an outer barrel connected to an upper end of the RCD housing 60, such as by a flanged connection, and an inner barrel connected to the flex joint 22, such as by a flanged connection. The outer barrel may also be connected to the tensioner 24, such as by a tensioner ring, and may further include a termination ring for connecting upper ends of the lines 27, 28 to respective hoses 27*h*, 28*h* leading to the MODU 1*m* (see FIG. 3A).

The flex joint 22 may also connect to a mandrel of the diverter 21, such as by a flanged connection. The diverter mandrel may be hung from the diverter housing during deployment of the riser 25. The diverter housing may also be connected to the rig floor 4, such as by a bracket. The slip joint 23 may be operable to extend and retract in response to heave of the MODU 1*m* relative to the riser 25 while the tensioner 24 may reel wire rope in response to the heave, thereby supporting the riser 25 from the MODU 1*m* while accommodating the heave. The flex joints 23, 43 may accommodate respective horizontal and/or rotational (aka pitch and roll) movement of the MODU 1*m* relative to the riser 25 and the riser relative to the PCA 1*p*. The riser 25 may have one or more buoyancy modules (not shown) disposed therealong to reduce load on the tensioner 24.

In operation, a lower portion of the riser 25 may be assembled using the running tool 38 and a riser spider (not shown). The riser 25 may be lowered through a rotary table 37 located on the rig floor 4 while coupled to the RCD housing 60, and thus, assembly within moonpool is minimized or eliminated. The PCA 1*p* may be lowered through the moonpool by assembling joints of the riser 25 using the flanges 25*f*. Once the PCA 1*p* nears the wellhead 50, the RCD housing 60 may be connected to an upper end of the riser 25 using the running tool 38 and spider. The RCD housing 60 may then be lowered through the rotary table 37 into the moonpool. The RCD housing 60 may then be lowered through the moonpool by assembling the other UMRP components (slip joint locked). The diverter mandrel may be landed into the diverter housing and the tensioner 24 connected to the tensioner ring. The tensioner 24 and slip joint 23 may then be operated to land the PCA 1*p* onto the wellhead 50 and the PCA latched to the wellhead.

The pod 48 and umbilical 49 may be deployed with the PCA 1*p* as shown. Alternatively, the pod 48 may be deployed in a separate step after the riser deployment operation. In this alternative, the pod 48 may be lowered to the PCA 1*p* using the umbilical 49 and then latched to a receptacle (not shown) of the LMRP. Alternatively, the umbilical 49 may be secured to the riser 25.

Figure 2A:
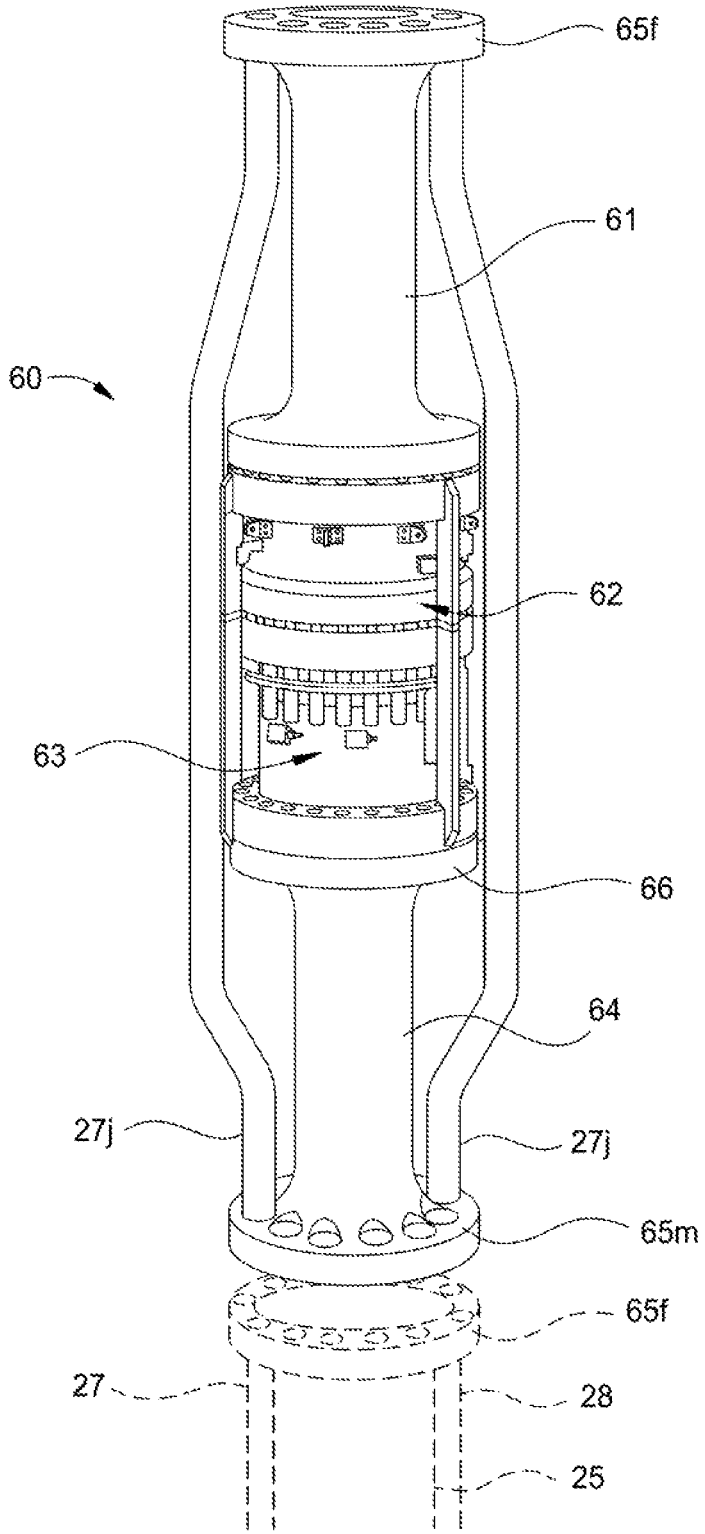
FIG. 2A illustrate a rotating control device (RCD) housing of the drilling system.
Figure 2B:
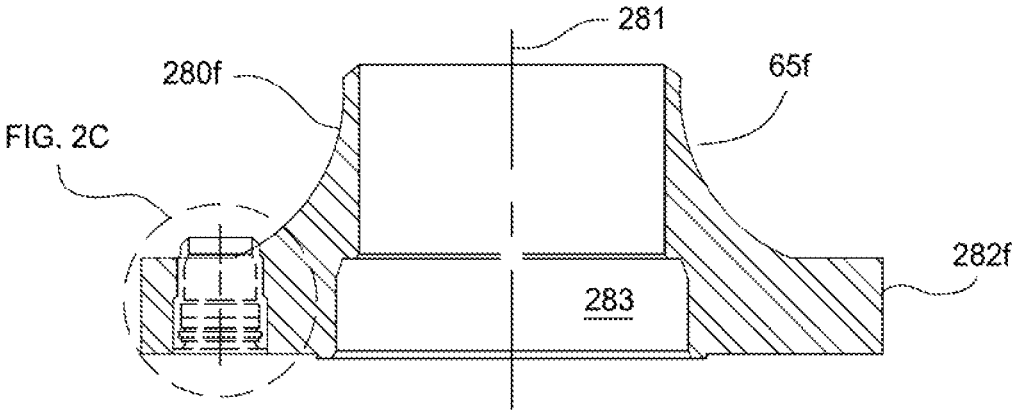
FIGS. 2B-2F illustrate riser flanges of the RCD housing.
Figure 2C:
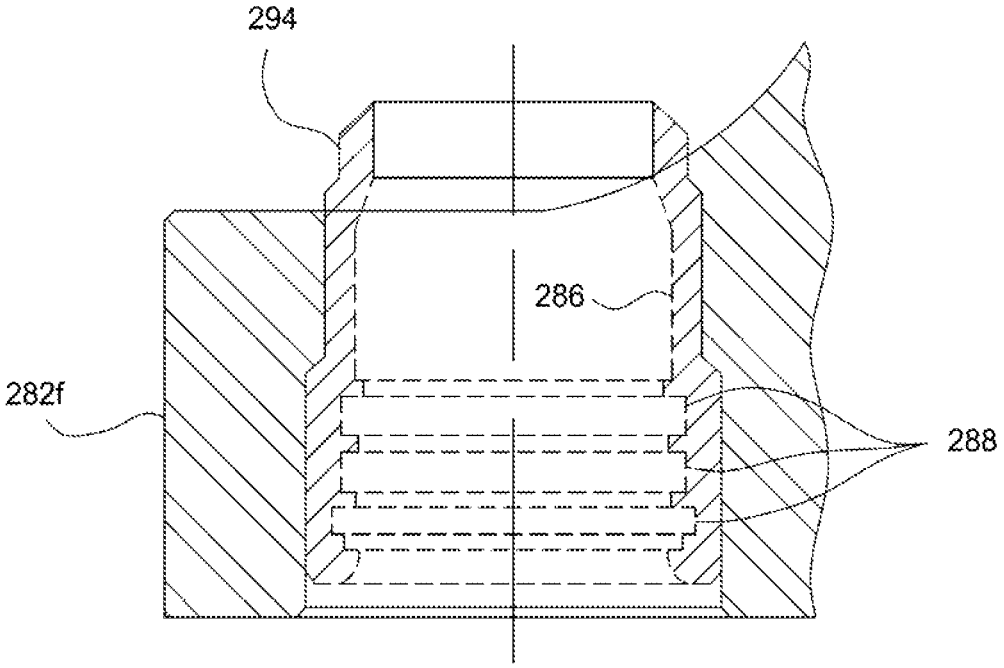
Figure 2D:
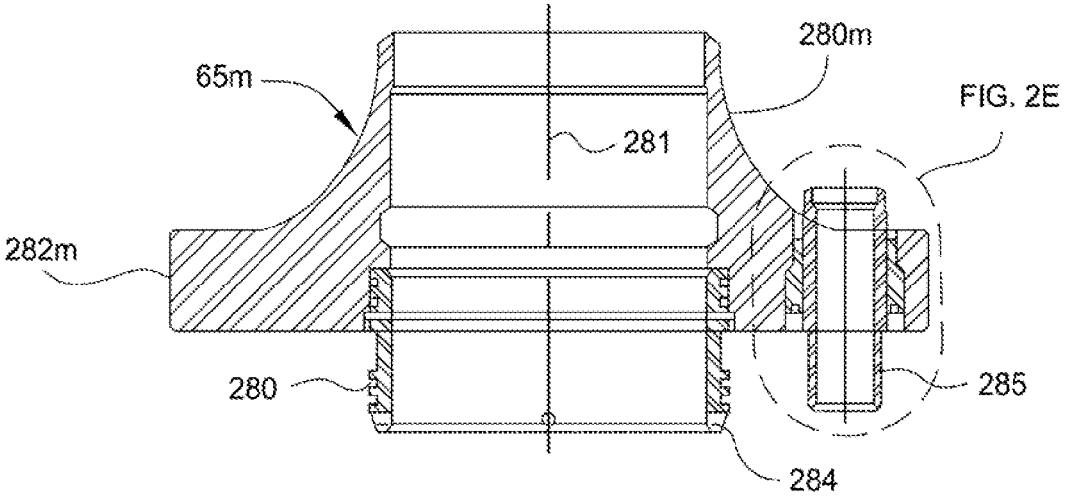
Figure 2E:
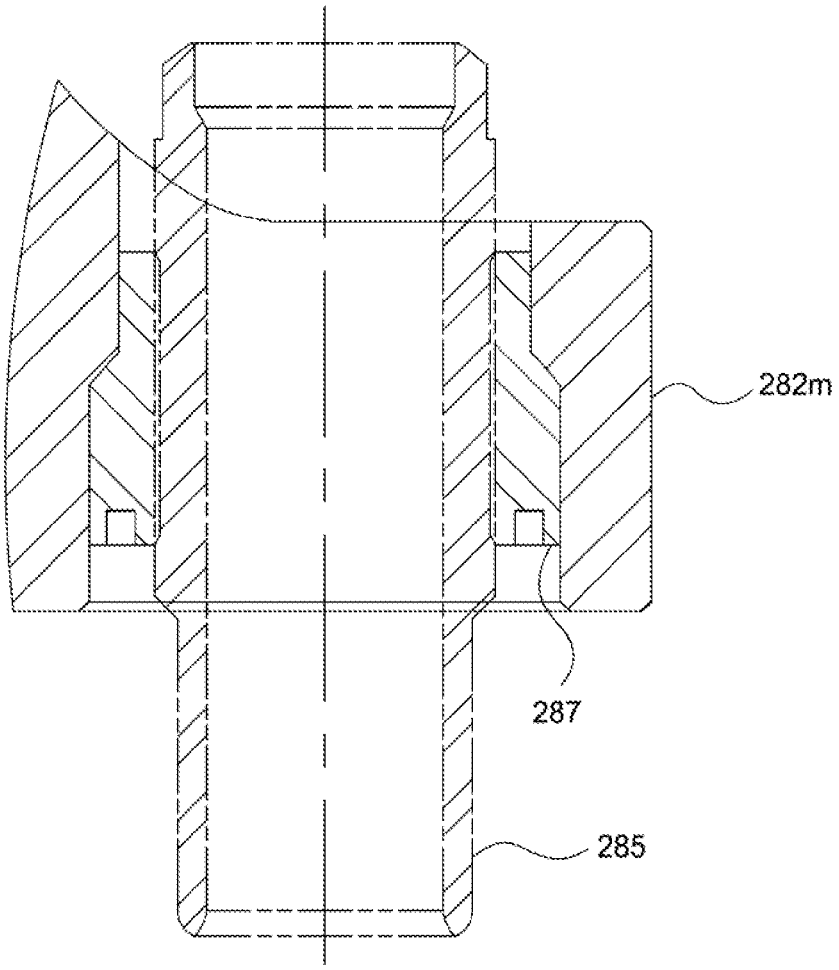
Figure 2F:
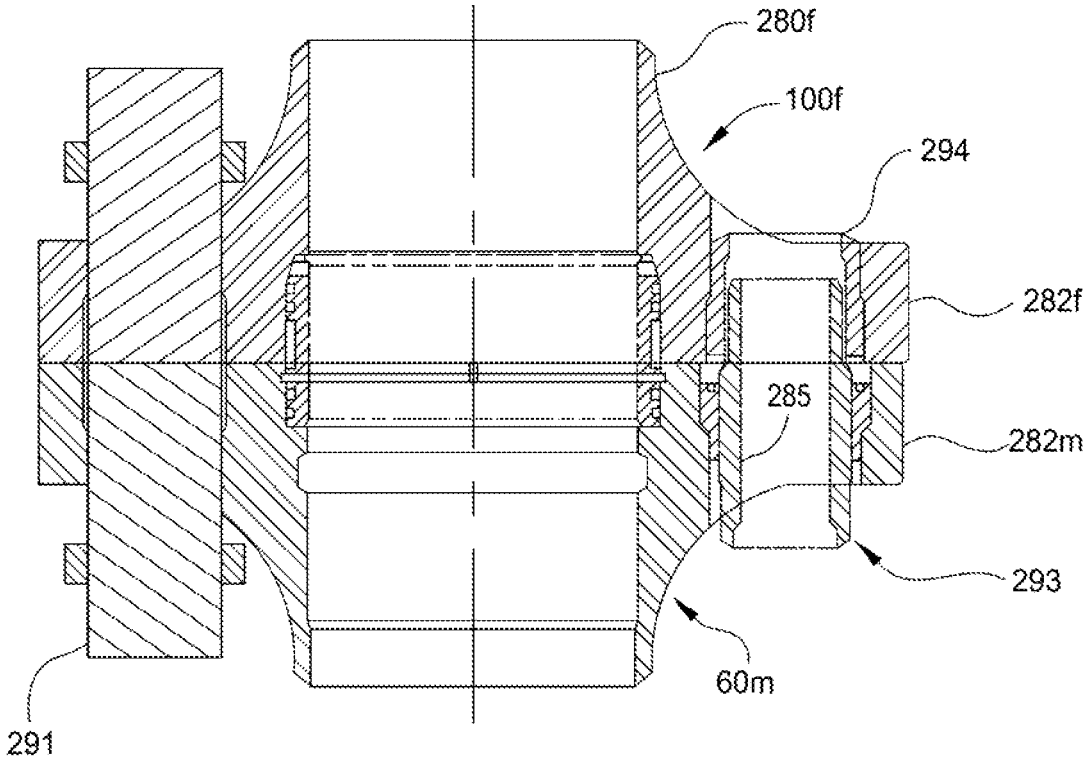

FIG. 2A illustrates the RCD housing 60. The RCD housing 60 may be tubular and have one or more sections 61-64 connected together, such as by flanged connections. The housing sections may include an upper spool 61, a latch section 62, a port section 63, and a lower spool 64. The RCD housing 60 may further include one or more auxiliary jumpers 27*j*, 28*j* for routing the booster line 27 and the choke line 28 around the latch 62 and port sections 63.

The lower spool 64 may be tubular and include an upper flange 66*u*, a lower flange 65*m*, and a body connecting the flanges, such as by being welded thereto. The upper flange 66*u* may mate with a lower flange of the port section 63, thereby connecting the two components. The lower flange 65*m* may mate with an upper flange 65*f* of the riser 25, thereby connecting the two components. The upper spool 61 may be tubular and include an upper flange 65*f*, a lower flange 66*b*, and a body connecting the flanges, such as by being welded thereto. The upper flange 65*f* may mate with a lower flange of the slip joint 23, thereby connecting the two components. The lower flange 66*b* may mate with an upper flange of the latch section 62, thereby connecting the two components. The upper flanges 66*u* and the lower flange 66*b* may be the same.

Each jumper 27*j*, 28*j* may be pipe made from a metal or alloy, such as steel, stainless steel, or nickel based alloy. Alternatively, each jumper 27*j*, 28*j* may be a hose made from a flexible polymer material, such as a thermoplastic or elastomer, or may be a metal or alloy bellows. Each hose may or may not be reinforced, such as by metal or alloy cords.

FIGS. 2B-2F illustrate the flanges 65*m,f*. Each flange 65*m,f* may have a bore 281 formed therethrough, a respective neck portion 280*m,f*, a respective rim portion 282*m,f*, and a coupling 285, 286 for each of the booster and choke lines 27, 28 or jumpers 27*j*, 28*j*. Each rim portion 282*m,f* may have sockets and holes (not shown) formed therethrough and spaced therearound in an alternating fashion. The holes may receive fasteners 291, such as bolts or studs and nuts. Each rim portion 282*m,f* may further have a seal bore 283 formed in an inner surface thereof and a shoulder formed at the end of the seal bore. A seal sleeve 284 may carry one or more seals 280 for each flange 65*m,f* along an outer surface thereof and be fastened to each male flange 65*m* with the seal therefore in engagement with the seal bore thereof. The seal bore of each female flange 65*f* may receive the respective seal sleeve 284 and the sleeve may be trapped between the seal bore shoulders.

Each flange socket may receive the respective coupling 285, 286. Each coupling 285, 286 may have an end 293, 294 for connection to the respective booster and choke lines 27, 28 or jumpers 27*j*, 28*j*, such as by welding. Each female coupling 286 may be retained in the respective flange socket by mating shoulders. Each male coupling 285 may have a nut 287 fastened thereto, such as by threads. The nut 287 may have a shoulder formed in an outer surface thereof for retaining the male coupling 285 in the respective flange socket. Each female coupling 286 may have a seal bore formed in an inner surface thereof for receiving a complementary stinger of the respective male coupling 285. The seal bore may carry one or more seals 288 for sealing an interface between the respective stinger. The stabbing depth of the male coupling 285 into the female coupling 286 may be adjusted using the nut 287.

Alternatively, each male coupling may carry the seals instead of the respective female coupling. Alternatively, the male-down convention illustrated in FIG. 1B may be reversed.

FIGS. 3A-3C illustrate the offshore drilling system 1 in an overbalanced drilling mode. Once the riser 25, PCA 1*p*, and UMRP 20 have been deployed, drilling of the lower formation 54*b* may commence. The running tool 38 may be replaced by a top drive 5 and a fluid handling system 1*h* may be installed. The drill string 10 may be deployed into the wellbore 55 through the riser 25, PCA 1*p*, UMRP 20 and casing 52.

The drilling rig 1*r* may further include a rail (not shown) extending from the rig floor 4 toward the crown block 8. The top drive 5 may include an extender (not shown), motor, an inlet, a gear box, a swivel, a quill, a trolley (not shown), a pipe hoist (not shown), and a backup wrench (not shown). The top drive motor may be electric or hydraulic and have a rotor and stator. The motor may be operable to rotate the rotor relative to the stator which may also torsionally drive the quill via one or more gears (not shown) of the gear box. The quill may have a coupling (not shown), such as splines, formed at an upper end thereof and torsionally connecting the quill to a mating coupling of one of the gears. Housings of the motor, swivel, gear box, and backup wrench may be connected to one another, such as by fastening, so as to form a non-rotating frame. The top drive 5 may further include an interface (not shown) for receiving power and/or control lines.

The trolley may ride along the rail, thereby torsionally restraining the frame while allowing vertical movement of the top drive 5 with the travelling block. The traveling block may be connected to the frame via the rig compensator to suspend the top drive from the derrick 3. The swivel may include one or more bearings for longitudinally and rotationally supporting rotation of the quill relative to the frame. The inlet may have a coupling for connection to a Kelly hose 17*h* and provide fluid communication between the Kelly hose and a bore of the quill. The quill may have a coupling, such as a threaded pin, formed at a lower end thereof for connection to a mating coupling, such as a threaded box, at a top of the drill string 10.

The drill string 10 may include a bottomhole assembly (BHA) 10*b* and joints of drill pipe 10*p* connected together, such as by threaded couplings. The BHA 10*b* may be connected to the drill pipe 10*p*, such as by a threaded connection, and include a drill bit 12 and one or more drill collars 11 connected thereto, such as by a threaded connection. The drill bit 12 may be rotated 13 by the top drive 5 via the drill pipe 10*p* and/or the BHA 10*b* may further include a drilling motor (not shown) for rotating the drill bit. The BHA 10*b* may further include an instrumentation sub (not shown), such as a measurement while drilling (MWD) and/or a logging while drilling (LWD) sub.

The fluid handling system 1*h* may include a fluid tank 15, a supply line 17*p,h*, one or more shutoff valves 18*a-f*, an RCD return line 26, a diverter return line 29, a mud pump 30, a hydraulic power unit (HPU) 32*h*, a hydraulic manifold 32*m*, a cuttings separator, such as shale shaker 33, a pressure gauge 34, the programmable logic controller (PLC) 35, a return bypass spool 36*r*, a supply bypass spool 36*s*. A first end of the return line 29 may be connected to an outlet of the diverter 21 and a second end of the return line may be connected to the inlet of the shaker 33. A lower end of the RCD return line 19 may be connected to an outlet of the RCD 63 and an upper end of the return line may have shutoff valve 18*c* and be blind flanged. An upper end of the return bypass spool 36*r* may be connected to the shaker inlet and a lower end of the return bypass spool may have shutoff valve 18*b* and be blind flanged. A transfer line 16 may connect an outlet of the fluid tank 15 to the inlet of the mud pump 30. A lower end of the supply line 17*p,h* may be connected to the outlet of the mud pump 30 and an upper end of the supply line may be connected to the top drive inlet. The pressure gauge 34 and supply shutoff valve 18*f* may be assembled as part of the supply line 17*p,h*. A first end of the supply bypass spool 36*s* may be connected to the outlet of the mud pump 30*d* and a second end of the bypass spool may be connected to the standpipe 17*p* and may each be blind flanged. The shutoff valves 18*d,e* may be assembled as part of the supply bypass spool 36*s*.

In the overbalanced drilling mode, the mud pump 30 may pump the drilling fluid 14*d* from the transfer line 16, through the pump outlet, standpipe 17*p* and Kelly hose 17*h* to the top drive 5. The drilling fluid 14*d* may flow from the Kelly hose 17*h* and into the drill string 10 via the top drive inlet. The drilling fluid 14*d* may flow down through the drill string 10 and exit the drill bit 12, where the fluid may circulate the cuttings away from the bit and carry the cuttings up the annulus 56 formed between an inner surface of the casing 52 or wellbore 55 and the outer surface of the drill string 10. The returns 14*r* may flow through the annulus 56 to the wellhead 50. The returns 14*r* may continue from the wellhead 50 and into the riser 25 via the PCA 1*p*. The returns 14*r* may flow up the riser 25 to the diverter 21. The returns 14*r* may flow into the diverter return line 29 via the diverter outlet. The returns 14*r* may continue through the diverter return line 29 to the shale shaker 33 and be processed thereby to remove the cuttings, thereby completing a cycle. As the drilling fluid 14*d* and returns 14*r* circulate, the drill string 10 may be rotated 13 by the top drive 5 and lowered by the traveling block, thereby extending the wellbore 55 into the lower formation.

The drilling fluid 14*d* may include a base liquid. The base liquid may be base oil, water, brine, or a water/oil emulsion. The base oil may be diesel, kerosene, naphtha, mineral oil, or synthetic oil. The drilling fluid 14*d* may further include solids dissolved or suspended in the base liquid, such as organophilic clay, lignite, and/or asphalt, thereby forming a mud.

Figure 4:
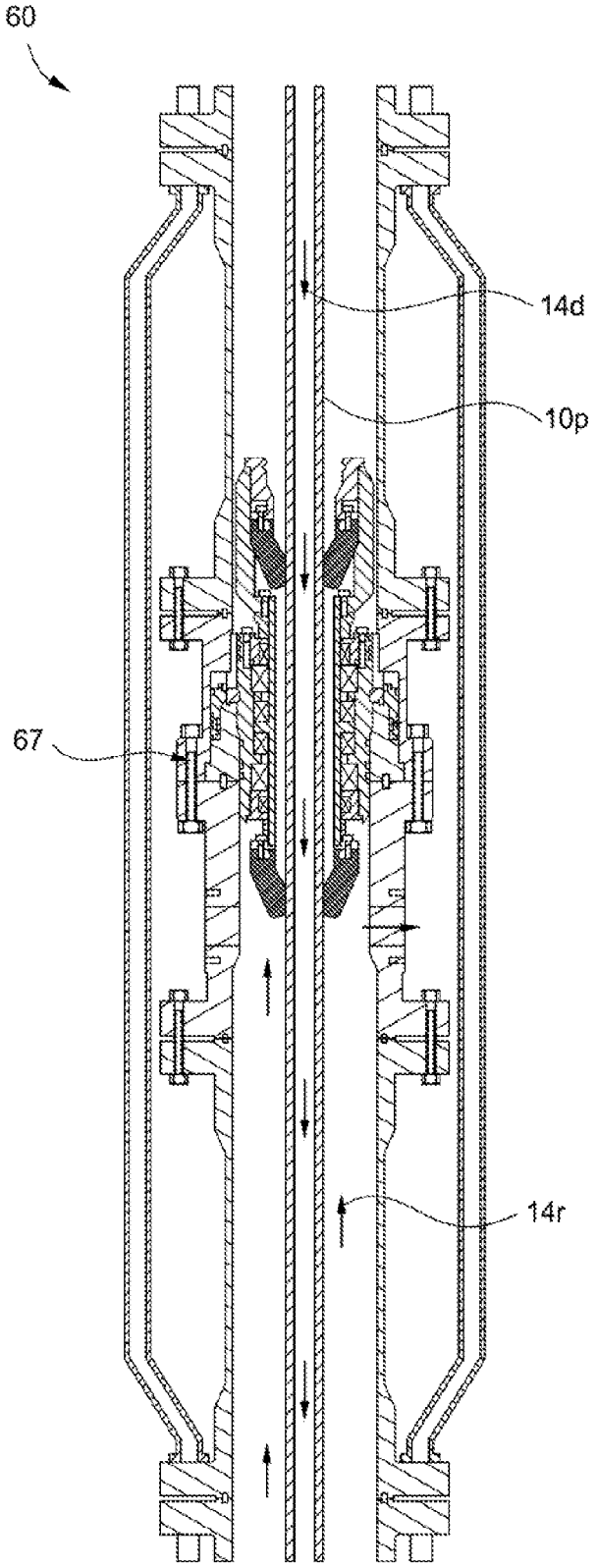
FIG. 4 illustrates the offshore drilling system in a managed pressure drilling mode.

FIG. 4 illustrates the offshore drilling system 1 in a managed pressure drilling mode. Should an unstable zone in the lower formation 54*b* be encountered, the drilling system 1 may be shifted into managed pressure mode. To shift the drilling system 1, a managed pressure return spool (not shown) may be connected to the RCD return line 26 and the bypass return spool 36*r*. The managed pressure return spool may include a returns pressure sensor, a returns choke, a returns flow meter, and a gas detector. A managed pressure supply spool (not shown) may be connected to the supply bypass spool 36*s*. The managed pressure supply spool may include a supply pressure sensor and a supply flow meter. Each pressure sensor may be in data communication with the PLC 35. The returns pressure sensor may be operable to measure backpressure exerted by the returns choke. The supply pressure sensor may be operable to measure standpipe pressure.

The returns flow meter may be a mass flow meter, such as a Coriolis flow meter, and may be in data communication with the PLC 35. The returns flow meter may be connected in the spool downstream of the returns choke and may be operable to measure a flow rate of the returns 14*r*. The supply flow meter may be a volumetric flow meter, such as a Venturi flow meter. The supply flow meter may be operable to measure a flow rate of drilling fluid 14*d* supplied by the mud pump 30 to the drill string 10 via the top drive 5. The PLC 35 may receive a density measurement of the drilling fluid 14*d* from a mud blender (not shown) to determine a mass flow rate of the drilling fluid. The gas detector may include a probe having a membrane for sampling gas from the returns 14*r*, a gas chromatograph, and a carrier system for delivering the gas sample to the chromatograph. Alternatively, the supply flow meter may be a mass flow meter.

Additionally, a degassing spool (not shown) may be connected to a second return bypass spool (not shown). The degassing spool may include automated shutoff valves at each end and a mud-gas separator (MGS). A first end of the degassing spool may be connected to the return spool between the gas detector and the shaker 33 and a second end of the degasser spool may be connected to an inlet of the shaker. The MGS may include an inlet and a liquid outlet assembled as part of the degassing spool and a gas outlet connected to a flare or a gas storage vessel. The PLC 35 may utilize the flow meters to perform a mass balance between the drilling fluid and returns flow rates and activate the degassing spool in response to detecting a kick of formation fluid.

The RCD 63 may be shifted from idle mode (FIG. 3A) to active mode (FIG. 4) by retrieving the protector sleeve and replacing the protector sleeve with the bearing assembly. Once the RCD 63 has been shifted, drilling may recommence in the managed pressure mode. The RCD 63 may divert the returns 14*r* into the RCD return line 26 and through the managed pressure return spool to the shaker 33. During drilling, the PLC 35 may perform the mass balance and adjust the returns choke accordingly, such as tightening the choke in response to a kick and loosening the choke in response to loss of the returns. As part of the shift to managed pressure mode, a density of the drilling fluid 14*d* may be reduced to correspond to a pore pressure gradient of the lower formation 54*b*.

The RCD 63 may include the housing 60, a piston, a latch, a protector sleeve (shown in FIG. 1B) and the bearing assembly. The bearing assembly may include a bearing pack, a housing seal assembly, one or more strippers 71, and a catch sleeve. The bearing assembly may be selectively longitudinally and torsionally connected to the housing by engagement of the latch with the catch sleeve. The latch section 62 may have hydraulic ports in fluid communication with the piston and an interface of the RCD 63. The bearing pack may support the strippers from the sleeve such that the strippers may rotate relative to the housing (and the sleeve). The bearing pack may include one or more radial bearings, one or more thrust bearings, and a self contained lubricant system. The bearing pack may be disposed between the strippers and be housed in and connected to the catch sleeve, such as by a threaded connection and/or fasteners.

Each stripper may include a gland or retainer and a seal. Each stripper seal may be directional and oriented to seal against drill pipe 10*p* in response to higher pressure in the riser 25 than the UMRP 20. Each stripper may have a conical shape for fluid pressure to act against a respective tapered surface thereof, thereby generating sealing pressure against the drill pipe 10*p*. Each stripper may have an inner diameter slightly less than a pipe diameter of the drill pipe 10*p* to form an interference fit therebetween. Each stripper may be flexible enough to accommodate and seal against threaded couplings of the drill pipe 10*p* having a larger tool joint diameter. The drill pipe 10*p* may be received through a bore of the bearing assembly so that the strippers may engage the drill pipe. The stripper seals may provide a desired barrier in the riser 25 either when the drill pipe 10*p* is stationary or rotating. Once deployed, the RCD 63 may be submerged adjacent the waterline 2*s*. The RCD interface may be in fluid communication with a hydraulic power unit (HPU) 32*h* (FIG. 3A) and a programmable logic controller (PLC) 35 via an RCD umbilical 19.

Alternatively, an active seal RCD may be used. Alternatively, the RCD 63 may be located above the waterline 2*s* and/or along the UMRP 20 at any other location besides a lower end thereof. Alternatively, the RCD 63 may be assembled as part of the riser 25 at any location therealong or as part of the PCA 1*p*. If assembled as part of the PCA 1*p*, the RCD return line 29 may extend along the riser 25 as one of the auxiliary lines.

Figure 5:
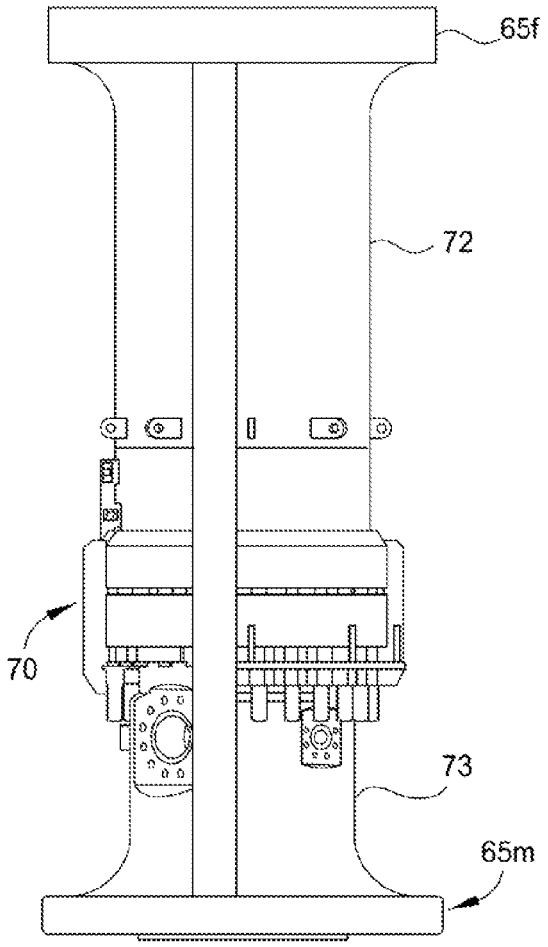
FIG. 5 illustrates an alternative RCD housing for use with the drilling system, according to another embodiment of the invention.

FIG. 5 illustrates an alternative RCD housing 70 for use with the drilling system, according to another embodiment of the invention. Returning to FIG. 1B, the flanged connection between the latch section 62 and the port 63 section may have a lesser outer diameter than the flanged connections between the spools and the respective latch and port sections. The spools 61, 64 have been omitted from the alternative RCD housing 70. Instead, the alternative RCD housing 70 has an extended latch section 72 with the riser flange 65*f* welded to an upper end thereof and a lower end of the port section 73 has the riser flange 65*m* welded thereto, thereby eliminating the larger flanged connections and reducing a required drift diameter of the rotary table 37 needed to pass the RCD housing 70 since an outward flare of the jumpers may be reduced. Alternatively, larger diameter jumpers may be accommodated.

Figure 6:
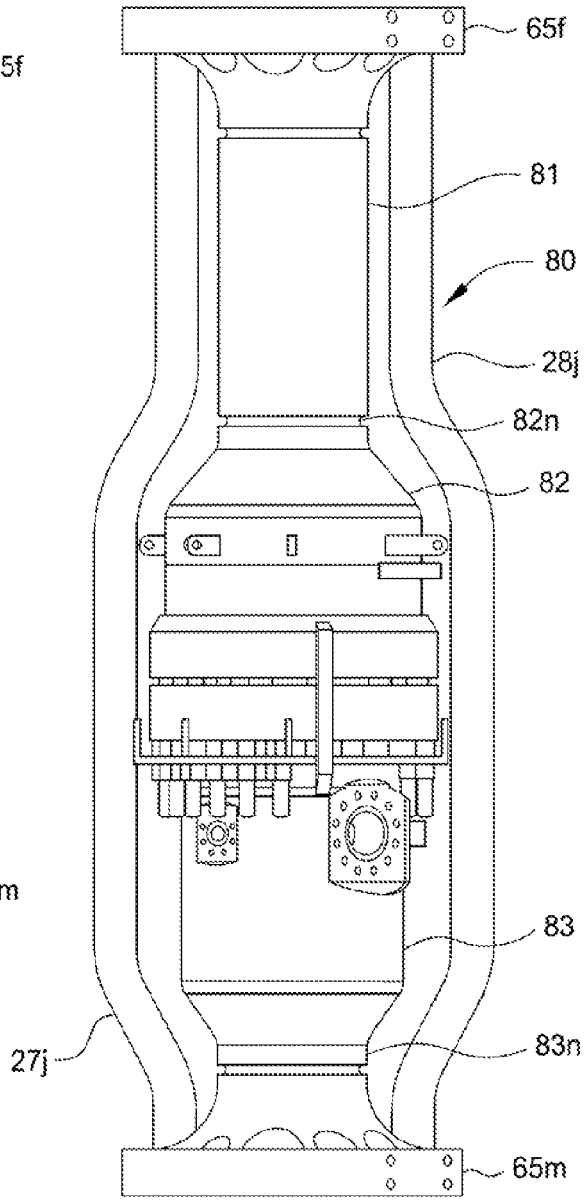
FIG. 6 illustrates an alternative RCD housing for use with the drilling system, according to another embodiment of the invention.

FIG. 6 illustrates an alternative RCD housing 80 for use with the drilling system, according to another embodiment of the invention. The alternative RCD housing 80 has a latch section 82 with a nipple 82*n* formed at an upper end thereof and an upper spool 81 welded to to the nipple. The alternative RCD housing 80 also has a port section 83 with a nipple 83*n* formed at a lower end thereof and a lower spool 84 welded to to the nipple, thereby eliminating the larger flanged connections and reducing an a required drift diameter of the rotary table 37 needed to pass the RCD housing 80 since an outward flare of the jumpers may be reduced. Alternatively, larger diameter jumpers may be accommodated.

Alternatively, it is contemplated that the connectors 100*f*, 60*m* may be integrally formed with the spools 500*s*, 560, or may coupled thereto via threaded connection.

Embodiments described herein provide RCD systems having diameters sufficiently small enough to fit through an opening of a rotary table while the RCD system is in an assembled configuration. In one example, the an RCD system may include a housing having flanges with a maximum diameter of 45 inches, and external piping having a maximum diameter of about 6.5 inches each. In an RCD system having two external pipes located about 180 degrees from one another, the total width of the RCD system would be about 58 inches. Thus, the RCD system can be disposed through a rotary table opening of about 59-60 inches, while having sufficient clearance and accounting for drift. The reduced dimensions of the RCD system are facilitated by flanged connections that allow fluid channels to pass therethrough, rather than around, at locations coupling the RCD system to risers (e.g., riser joints).

While the foregoing is directed to embodiments of the present invention, other and further embodiments of the invention may be devised without departing from the basic scope thereof, and the scope thereof is determined by the claims that follow.

The invention claimed is:

1. A rotating control device (RCD) housing for use with a riser, comprising:

an upper riser flange connectable to a first riser flange of the riser;

a lower riser flange connectable to a second riser flange of the riser;

a latch section for receiving a bearing assembly;

a first nipple having a tapered outer diameter, the first nipple coupled to the latch section;

a port section connected to the latch section by a flanged connection;

a second nipple having a tapered outer diameter and coupled to the port section and the lower riser flange;

a jumper connected to the upper and lower riser flanges; and wherein one of the upper or lower riser flanges includes a male coupling extending through an opening formed in the upper or lower riser flange, the male coupling adapted to connect to the jumper and to transfer a fluid therethrough, wherein the male coupling includes a threaded nut disposed therearound for adjusting a penetration depth of the male coupling within a respective female coupling;

wherein the other riser flange of the upper or lower riser flanges includes a female coupling for receiving a respective male coupling therein and for transferring a fluid therethrough, wherein the female coupling includes a seal bore having one or more seals disposed on an internal surface thereof.

2. The rotating control device housing of claim 1, wherein the female coupling is adapted to couple to the jumper.

3. The rotating control device housing of claim 1, wherein the nut is adapted to seat against a shoulder formed within the opening of the lower riser flange.

4. The rotating control device housing of claim 2, wherein the one riser flange includes two male couplings, and wherein the other riser flange includes two female couplings.

5. The rotating control device housing of claim 1, wherein one of the upper or lower riser flanges has a central bore formed therethrough, at least part of the bore defined by a seal sleeve having one or more seals on an outer surface thereof.

6. The rotating control device housing of claim 5, wherein the other riser flange of the upper or lower riser flange has a central bore formed therethrough, the central bore of the other riser flange adapted to receive a corresponding seal sleeve.

7. The rotating control device housing of claim 1, wherein the port section has an outlet for discharging fluid flow diverted by the bearing assembly.

8. The rotating control device housing of claim 1, further comprising the bearing assembly, comprising:

a stripper seal for receiving and sealing against a tubular;

a bearing for supporting rotation of the stripper seal relative to the RCD housing;

a retainer for connecting the stripper seal to the bearing; and a catch sleeve for engagement with the latch section.

9. A method for deploying a marine riser, comprising:

assembling the marine riser;

connecting the lower riser flange of the RCD housing of claim 1 to an upper riser flange of the marine riser, wherein connecting the lower riser flange of the RCD housing to the upper riser flange of the marine riser places the jumper in fluid communication with an auxiliary line of the marine riser;

connecting a lower riser flange of another upper marine riser package (UMRP) component to the upper riser flange of the RCD housing; and lowering the RCD housing through a rotary table and moonpool of an offshore drilling unit by further assembly of the UMRP after placing the jumper in fluid communication with the auxiliary line of the marine riser.

10. The method of claim 9, wherein the UMRP has a termination ring receiving an upper end of the auxiliary line.

11. The method of claim 9, further comprising:

landing a diverter mandrel of the UMRP into a diverter housing;

connecting a tensioner to a tensioner ring of the UMRP; and operating a slip joint of the UMRP to land a pressure control assembly connected to a lower end of the marine riser onto a subsea wellhead.

12. The method of claim 9, further comprising:

deploying a drill string into a subsea wellbore through the marine riser; and drilling the subsea wellbore using the drill string.

13. The method of claim 12, further comprising:

deploying a bearing assembly to the RCD housing, wherein the bearing assembly engages the drill string and diverts drilling returns from the marine riser to the offshore drilling unit.

14. The method of claim 13, further comprising retrieving a protector sleeve from the RCD housing before deploying the bearing assembly thereto.

* * * * *